United States Patent [19]

Ginnow

[11] 4,362,515

[45] Dec. 7, 1982

[54] MARINE DRIVE VANE STEERING SYSTEM

[75] Inventor: Russell F. Ginnow, Oshkosh, Wis.

[73] Assignee: Brunswick Corporation, Skokie, Ill.

[21] Appl. No.: 139,001

[22] Filed: Apr. 10, 1980

[51] Int. Cl.[3] ..... B63H 21/26

[52] U.S. Cl. ..... 440/62; 114/144 R

[58] Field of Search ..... 114/144 R, 146, 163, 114/152, 162, 164; 440/51, 53, 52, 62, 63, 66

[56] References Cited

U.S. PATENT DOCUMENTS

| | | | |
|---|---|---|---|
| 2,993,464 | 7/1961 | Conover . | |
| 3,149,605 | 9/1964 | Broadwell | 440/53 X |
| 3,774,568 | 11/1973 | Borst et al. | 114/144 R |
| 3,943,878 | 3/1976 | Kirkwood et al. . | |
| 4,054,102 | 10/1977 | Borst et al. | 114/144 R |

FOREIGN PATENT DOCUMENTS

| | | | |
|---|---|---|---|
| 822357 | 11/1951 | Fed. Rep. of Germany | 114/144 R |

*Primary Examiner*—Trygve M. Blix
*Assistant Examiner*—Stephen P. Avila
*Attorney, Agent, or Firm*—Andrus, Sceales, Starke & Sawall

[57] ABSTRACT

An improved steering system includes a guide tube (29) fixed to the end of the outer casing of a steering cable (27). A link rod (32) connects between the steering arm (19) and the inner core (30) of the steering cable. A guide means (33) is fixed with respect to the transom support means to guide the linear movement of the inner core (30). A limiting means (49) limits the range of movement of the inner core (30) and a restoring means (49) moves the steerable drive unit (13) from the extreme range of the range of movement of the ram (31).

6 Claims, 6 Drawing Figures

MARINE DRIVE VANE STEERING SYSTEM

TECHNICAL FIELD

A marine drive such as a stern drive or outboard engine utilizes a vane rotatably mounted behind the propeller to assist in steering the drive. The vane is rotated in the direction the boat turns and assists in turning the drive.

BACKGROUND ART

U.S. Pat. No. 2,993,646 to Conover discloses an early vane steering system. The system utilizes a tensioned cable (commonly called cable steering) connected between the steering wheel and the outboard engine. Movement of the steering wheel pulls the cable to turn the vane. The vane in turn steers the engine. When the vane reaches a pre-determined limit without steering the engine the cable steers the engine directly.

U.S. Pat. No. 3,943,878 to Kirkwood discloses a similar vane steering system utilizing a push-pull cable connected between the steering wheel and the outboard engine. Movement of the steering wheel initially moves the push-pull cable casing to turn the vane. The vane in turn steers the engine. When the vane reaches a predetermined limit without steering the engine the push-pull cable core steers the engine directly.

DISCLOSURE OF INVENTION

The object of the present invention is to provide a restoring means to provide a smooth transitional restoring force to the vane between a direct steering mode and a steering assist mode.

Another object of the present invention is to provide a marine drive with a vane steering system having a vane steering mode, a direct steering mode and a transitional assisting/restoring mode.

The invention comprises an improved steering system including a guide tube fixed to the end of the outer casing of the steering cable, a link rod connected between the steering arm of the marine drive and the inner core of the steering cable, a guide means fixed with respect to the transom support means to guide the linear movement of the inner core, a limiting means for limiting the range of movement of the inner core, and restoring means to move the steerable drive unit from the extreme range of the range of movement of the ram.

Surprisingly the improved steering system helps with the steering effort of the boat operator and smooths the steering during the transition from a direct steering mode to a steering assist mode.

BEST MODE FOR CARRYING OUT THE INVENTION

Figure 1:
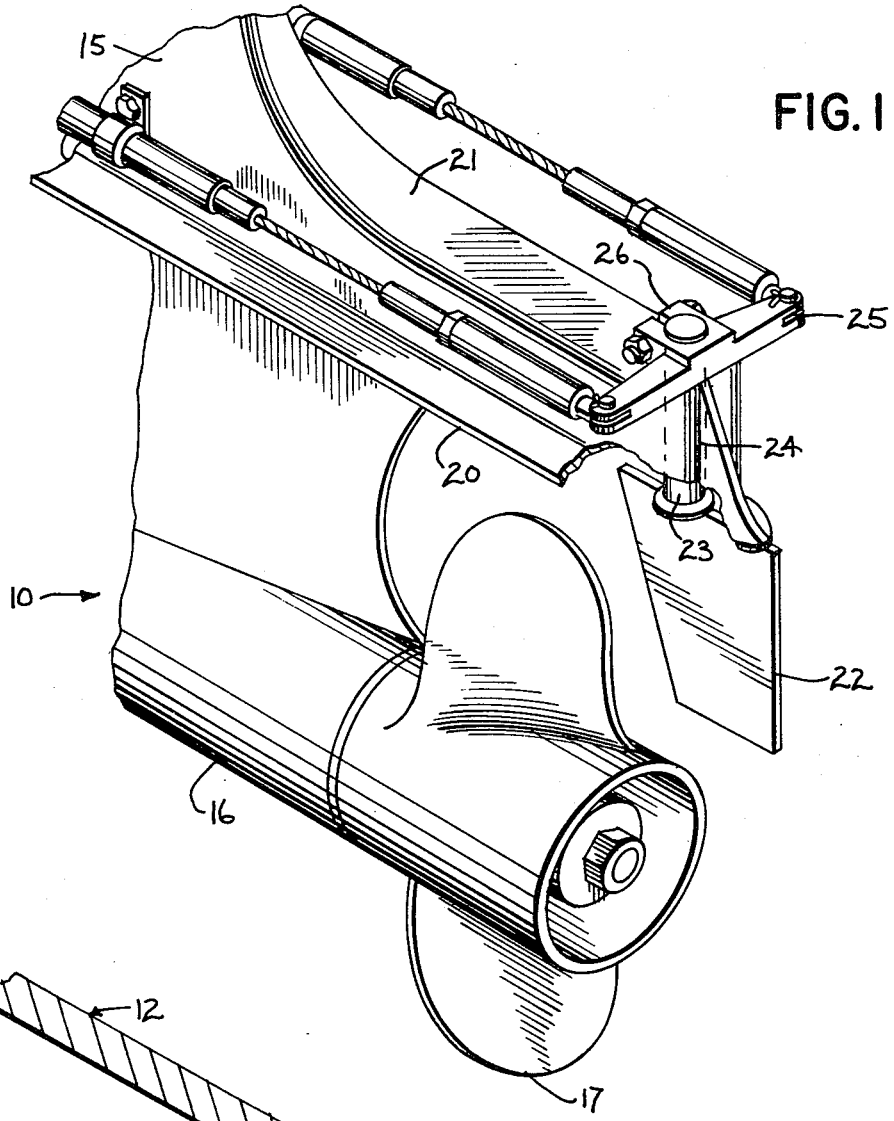
FIG. 1 is a perspective view of a drive unit of a steerable marine drive illustrating the vane steering system of the present invention.
Figure 2:
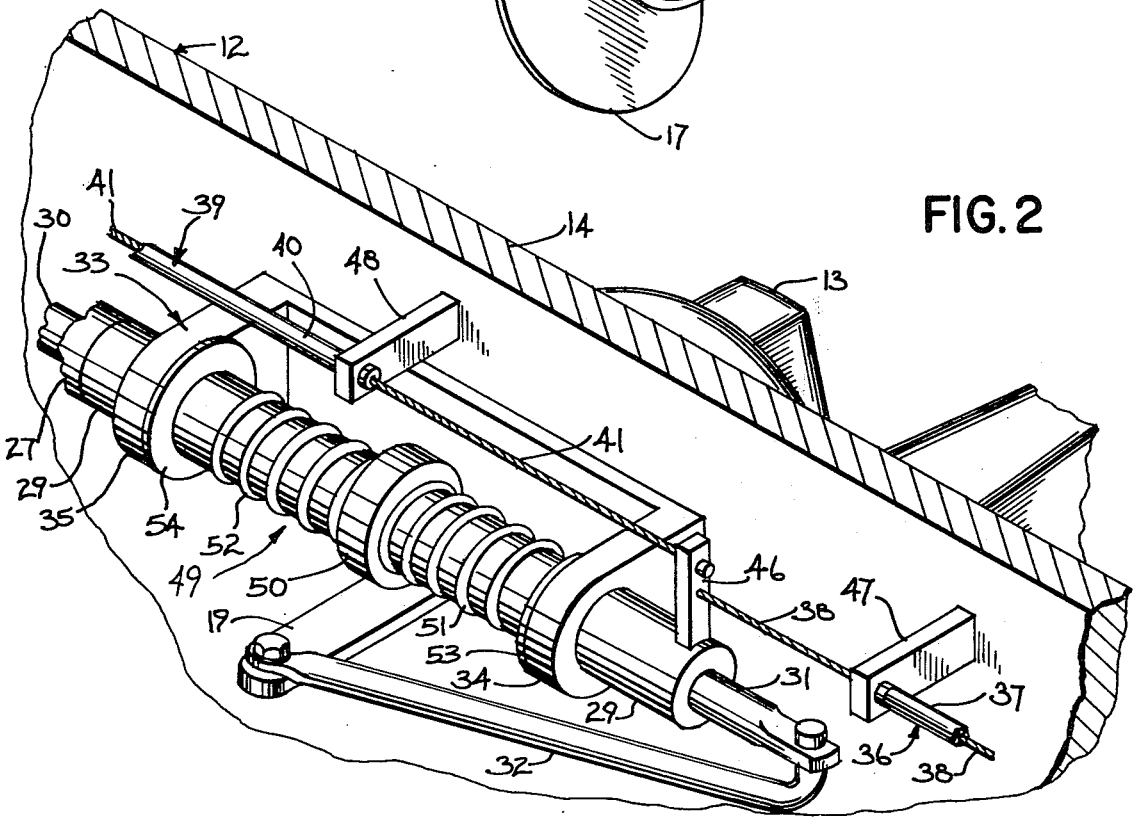
FIG. 2 is a perspective view of additional portions of the vane steering system of FIG. 1 located at the transom of the boat.
Figure 3:
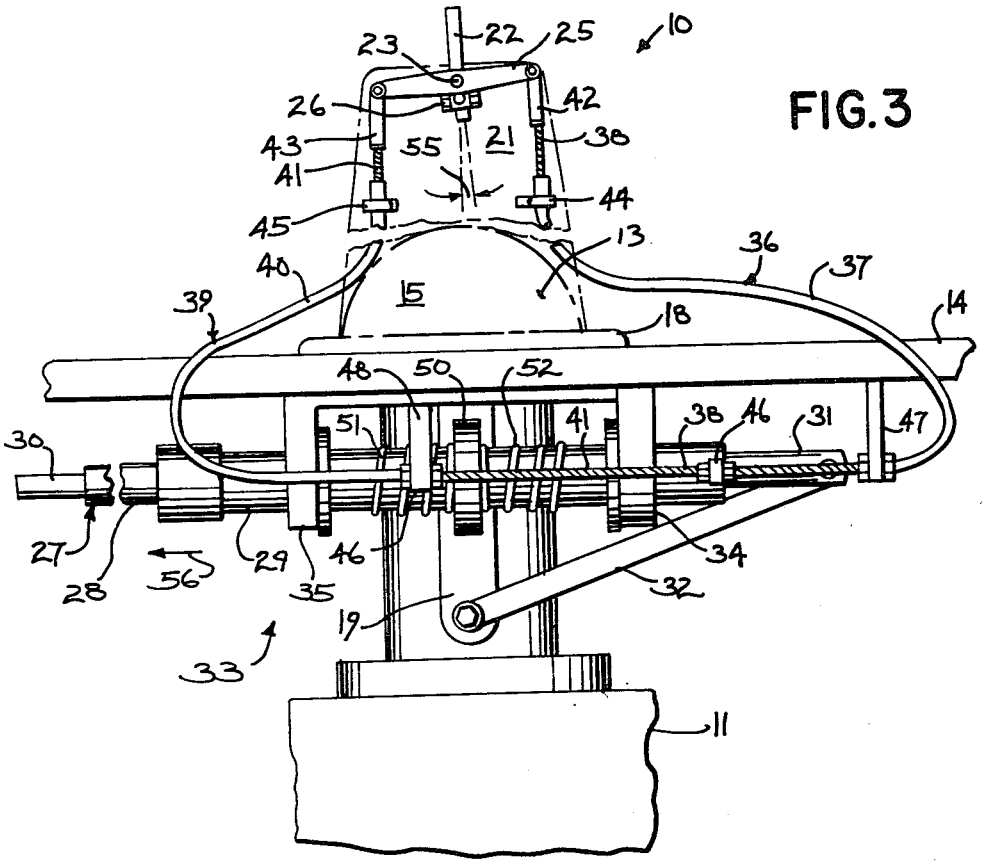
FIG. 3 is a partial top view of the vane steering system illustrating the connection to the components shown in FIGS. 1 and 2 and an initial condition of the steering system.
Figure 4:
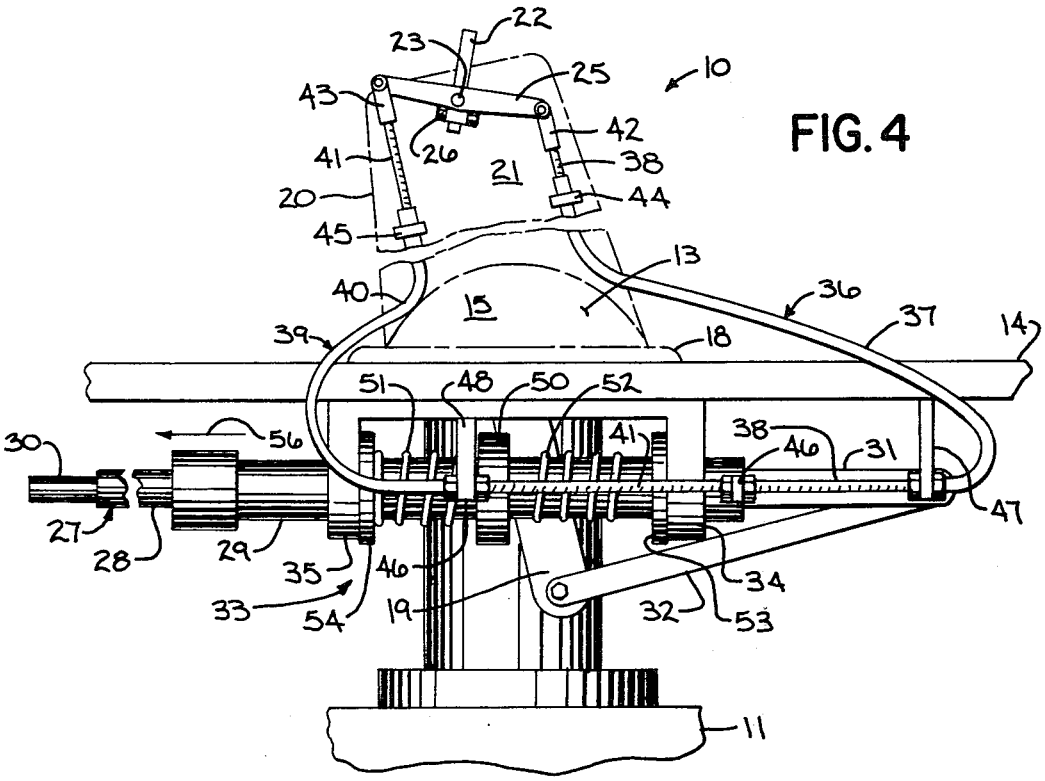
FIG. 4 is a partial top view similar to FIG. 3 showing a subsequent condition in the steering system.

The vane steering may be used on a marine drive such as an outboard engine or a stern drive 10 such as shown in FIGS. 1, 2, 3 and 4. The stern drive 10 includes an engine 11 mounted within the boat 12 connected to a drive unit 13. The drive unit 13 includes a steerable driveshaft housing 15 and a lower gearbox 16. The lower gearbox 16 includes a propeller shaft (not shown) upon which a propeller 17 is attached. The drive unit 13 is attached to a transom plate 18 through a gimbal means (not shown) which provides steering and tilting of the drive unit 13. A steering arm 19 attaches to the drive unit 13 and extends through the transom 14 as is shown in FIGS. 2, 3 and 4.

An anti-cavitation plate 20 having a substantially horizontal surface 21 is positioned between the steerable driveshaft housing 15 and the lower gearbox 16 to extend rearward from the boat 12 over the propeller 17. A vane 22 is vertically positioned behind the propeller 17 on a substantially vertical pivot shaft 23 rotatably supported in a bearing 24 in the anti-cavitation plate 20. A vane rotating member 25 is positioned above the anti-cavitation plate 20 with the central portion fixed to the top of the pivot shaft 23 by a clamping means 26 as shown in FIG. 1. The vane rotating member 25 is connected to provide a vane steering mode as will be described.

FIGS. 2, 3 and 4 illustrate the stern drive end of a push-pull steering cable steering system. In the steering system a steering wheel (not shown) is connected to move the inner core of the push-pull cable 27. The push-pull steering system designation occurs since when the steering wheel is turned one direction the cable core pulls and when the steering wheel is turned the other direction the cable core pushes. The outer casing of the push-pull cable 27 is fixed at the steering wheel end.

Figure 6:
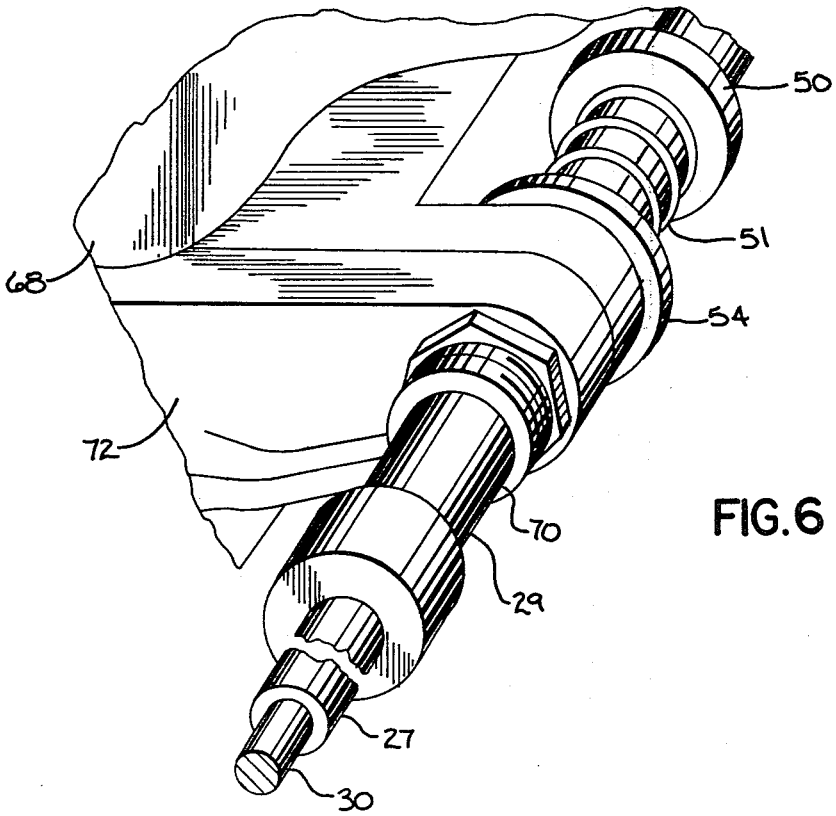
FIG. 6 is a partial perspective view showing use of the invention with an outboard engine.

Referring to FIG. 2, the push-pull cable casing 28 ends in a guiding tube 29 and the push-pull cable core 30 ends in a ram 31. A link rod 32 connects between the end of the ram 31 and the steering arm 19 as shown in FIG. 2. A guiding means 33 is fixed with respect to the transom plate 18. In the preferred embodiment shown in FIG. 2 the guiding means 33 includes a first guide member 34 and a second guide member 35 spaced from the first guide member 34. In an outboard engine 68 shown in FIG. 6 the guiding means is a tilt tube 70. The tilt tube 70 is a hollow pivot pin which permits the outboard engine to tilt out of the water. The tilt tube is part of the transom bracket 72.

A pull-pull vane steering system is generally connected between the vane rotating member 25 and the guiding means 33. The pull-pull vane steering system designation occurs because each of the two cables only pull. Referring to FIGS. 1 and 2 a first vane control cable 36 includes a first vane cable casing 37 and a first vane cable core 38 and a second vane control cable 39 includes a second vane cable casing 40 and a second vane cable core 41. The drive unit end of the first vane control cable 36 has the core 38 attached by a first adjustment means 42 to the port side of the vane rotating member 25 and the second vane control cable 39 has the core 41 attached by a second adjustment means 43 to the starboard side of the vane rotating member 25. The drive unit end of the first vane control cable 36 has the casing 37 attached to the side of the steerable driveshaft housing 15 by a clamp 44 and the second vane control cable 39 has the casing 40 attached to the side of the steerable driveshaft housing 15 by a clamp 45. The transom plate end of the first vane control cable 36 has the core 38 attached to the vane cable anchor 46 extending outward from and fixed to the guide tube 29 and the second vane control cable 39 has the core 41 attached to the vane cable anchor 46. The transom plate end of the first vane control cable 36 has the casing 37 attached to a first vane casing anchor 47 fixed to the transom plate 18 and/or transom 14 and the second vane control cable 39 has the casing 40 attached to a second vane casing anchor 48 also fixed to the transom plate 18 and/or transom 14. The relative positions of the anchors 46, 47 and 48 provide substantially parallel routing of the first vane control cable 36, the second vane control cable 39 and the push-pull cable 27 with guide tube 29.

A limiting means and restoring means is generally described by number 49. In the preferred embodiment the limiting means is a collar or stop 50 fixed to the guide tube 29 between the first guide member 34 and the second guide member 35. In the preferred embodiment the stop 50 is substantially centered between the guide members 34 and 35. The stop 50 also may be displaced towards one or the other of the guide members 34 and 35 to compensate for propeller torque or other steering variables. The restoring means includes a first spring 51 positioned over the guide tube 29 and between the stop 50 and the first guide member 34 and a second spring 52 also positioned over the guide tube 29 and between the stop 50 and the second guide member 35. Spacers 53 and 54 are positioned between the ends of the springs 51 and 52 and the first guide member 34 and the second guide member 35 to provide adjustment of the range of movement of the vane 22 and for varying the damping rate or restoring force provided by the restoring means.

STEERING SYSTEM OPERATION

The steering system described above operates in three different steering modes. The first steering mode is where the vane is moved and it in turn steers the marine drive; the second steering mode is where the vane has moved to an extreme position against a stop and the push-pull cable directly steers the marine drive; and the third steering mode is where the vane is turned to an extreme position where the restoring springs are compressed to provide a wider range of movement of the vane and where upon returning to a vane steering mode the restoring means provides a tansitional steering mode.

VANE STEERING MODE

In the operation during the vane steering mode the pivot shaft 23 is mounted to the vane 22 with a larger surface area of the vane 22 provided rearwardly from the drive unit 13. When the vane 22 is rotated such that the water stream passing parallel to the direction of travel of the boat 12 contacts the larger surface of the vane 22, the water stream provides a turning force which moves the drive unit 13. The turning force exerted by the vane 22 provides the vane steering mode.

The operation of the vane steering mode is best shown in FIGS. 3 and 4. FIG. 3 illustrates a straightahead movement of the boat 12. Even in the straightahead movement the vane 22 is slightly offset as shown by the dimension 55 in FIG. 3 to compensate for the torque produced by the propeller 17. The slight offset is required to maintain a straightahead movement. To turn to starboard the steering wheel is turned clockwise as is conventional. In a conventional steering system in which the casing is fixed at the transom, the core 30 of the push pull cable 27 would move the link rod 32 that in turn would move the steering arm 19 to turn the marine drive 10. In the vane steering system described above, the vane 22 is moved to steer the boat 12. The casing 28—guiding tube 29 are not fixed at the transom but are free to move in guiding means 33 responsive to forces in the steering system. Therefore, instead of the ram 31 moving first, the initial movement of the steering wheel causes an opposite movement of the casing 28 of the push-pull cable 27 with the attached guiding tube 29. Ram 31 is held stationary by the steering friction of the marine drive. Turning the steering wheel, with the ram so restained, flexes the entire cable. This flexing termed windup or lost motion, translates into opposite motion of the casing 27 at the marine drive end. The casing moves until the lost motion is taken up. It is the movement of the casing which initiates the turning of the vane 22. The movement of the guide tube 29 is connected to the vane 22 by the first and second vane control cables 36 and 39, respectively. Therefore to begin the turn to starboard the guide tube 29 moves to starboard as shown by the directional arrow 56. This movement pulls the first core 38 to rotate the vane 22 to port. The movement of the guide tube 29 also relaxes or allows the second core 41 to follow thereby permitting this movement of the vane 22 to port. Immediately after the vane 22 is turned port and into the water stream the force of this water stream acts on the vane 22 to steer the drive unit 13 to starboard. Simultaneously or in an instantaneous response the steering arm 19, link rod 32 and ram 31 follow the movement of the marine drive 10. Steering to port occurs in a similar manner.

DIRECT STEERING MODE

Since the vane steering mode depends on a water force exerted against the vane 22 to steer the marine drive 10 it is believed that when such a water force is not present the vane 22 does not steer but merely moves until it reaches one of the extremes or limits as defined by the stop 50. It is believed that this generally occurs at very slow speeds.

The direct steering mode occurs when the stop 50 is against but not compressing either the first spring 51 or the second spring 52. When the springs 51 and 52 are not compressed they act as stops to engage the direct steering mode.

TRANSITIONAL STEERING MODE

The transitional steering mode occurs where one of the first or second springs, 51 or 52, is compressed. This compression results in a smooth dampened transition from the direct steering mode to the vane steering mode. The vane steering mode and the transitional steering mode are both considered assisting modes since they reduce the level of steering force required from the boat operator.

Figure 5:
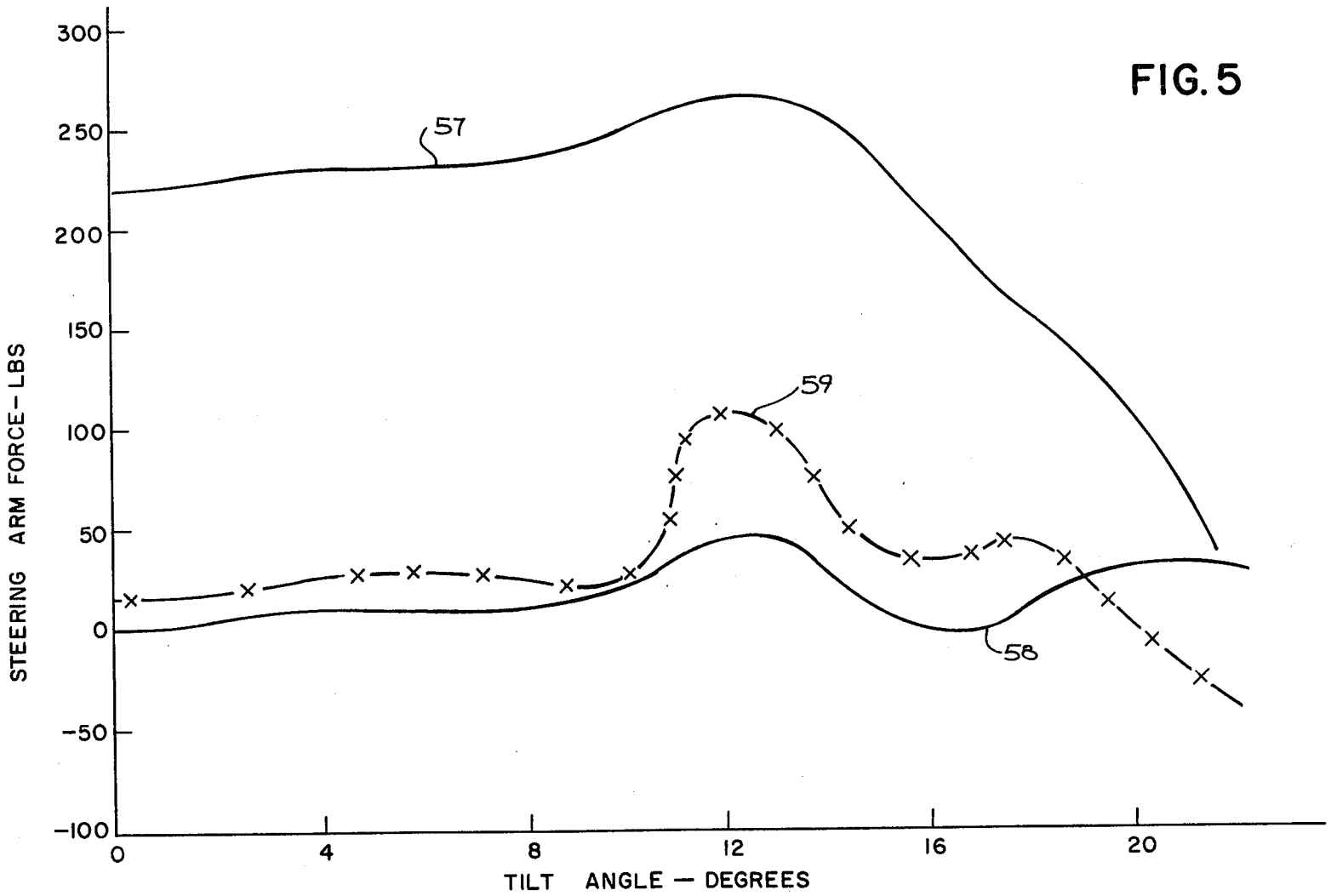
FIG. 5 is a graph showing a comparison of steering arm forces.

FIG. 5 is a graph comparing the steering forces at the steering arm in pounds of force for a conventional steering system and for the vane assisted steering system of the present invention. All data was gathered using a 17-foot boat having a 260 horsepower stern drive utilizing a 23-inch propeller. All data was also gathered at a wide open throttle speed. Although the data is shown as lines or curves the comparison is best made by comparison of the steering arm force at different trim angles. These curves are not continuous curves but connect together data gathered at each trim angle. The curve 57 illustrates the steering arm force at each of the different trim positions for a conventional steering system without a vane assist. This curve shows that the steering arm force is about 50 pounds at a 22 degree trim angle and about 250 pounds at a 12 degree trim angle. The curve 58 illustrates the steering arm force of the vane assist steering system of the present invention with the vane having a surface area of about 20.4 square inches. At a 12 degree trim angle the steering arm force is about 20 pounds. This is compared to the about 250 pounds for the conventional steering system illustrated in curve 100. The curve 59 illustrates a vane assist steering system with a smaller vane having a surface area of about 13.8 square inches. It is noted that the steering arm force with this vane at a 12 degree trim angle is in the order of 100 pounds.

I claim:

1. In a marine drive for mounting in a boat, (A) an engine, (B) a steerable drive unit connected to said engine, (C) transom support means for attachment of said marine drive to the boat, (D) a steering arm fixed to said drive unit for steering said marine drive, (E) a lower gearbox attached to said drive unit, (F) a horizontal propeller shaft positioned in said gearbox, (G) a propeller fixed to said propeller shaft for rotation with said propeller shaft, (H) an anti-cavitation plate having a substantially horizontal surface positioned above said propeller, (I) a steering means connected to move said steering arm said steering means including a push-pull steering cable having an inner core supported in an outer casing, (J) a vane vertically positioned behind said propeller on a substantially vertical pivot shaft rotatably supported in said anti-cavitation plate, (K) vane rotating means connected to rotate said vane on said pivot shaft upon an initial movement of said steering means, said vane rotating means having an inner core supported by an outer casing, wherein the improvement comprises a steering system including:

(a) a guide tube fixed to the end of the outer casing of said steering cable, (b) a link rod connecting between said steering arm and the inner core of said steering cable, (c) a guide means fixed with respect to said transom support means to guide the linear movement of said guide tube, (d) a limiting means for limiting the range of movement of said guide tube, and (e) restoring means to move said steerable drive unit from the extreme range of said range of movement of said steering arm.

2. The marine drive defined in claim 1 wherein said guide means includes:

(i) a first guide member, and (ii) a second guide member spaced from said first guide member, and said limiting means includes a movement limiting member positioned between said first and second guide members and fixed to said guide tube.

3. The marine drive defined in claim 2 wherein said restoring means includes:

(a) a first spring positioned over said guide tube and between said movement limiting member and said first guide member, (b) a second spring positioned over said guide tube extension and between said movement limiting member and second guide member.

4. The marine drive defined in claim 1 wherein said marine drive is an outboard engine and said guide means is a tilt tube.

5. The marine drive defined in claim 1 further including:

(f) adjustment means connected in said first and second vane cable to provide tension within each of said cables.

6. The marine drive defined in claim 1 further including:

(g) a first vane casing anchor for said first vane cable fixedly holding said first vane casing with respect to said support means, (h) a second vane casing anchor for said second vane cable fixedly holding said second vane casing with respect to said support means, (i) a vane core anchor fixing the end of each of said first and second vane cables to said guide tube.

* * * * *